US010655437B2

(12) United States Patent
Sablok et al.

(10) Patent No.: US 10,655,437 B2
(45) Date of Patent: May 19, 2020

(54) BUOYANT SYSTEM AND METHOD WITH BUOYANT EXTENSION AND GUIDE TUBE

(71) Applicant: TECHNIP FRANCE, Courbevoie (FR)

(72) Inventors: Anil Kumar Sablok, Houston, TX (US); Xiaohua Lu, Katy, TX (US)

(73) Assignee: TECHNIP FRANCE, Courbevoie (FR)

( * ) Notice: Subject to any disclaimer, the term of this patent is extended or adjusted under 35 U.S.C. 154(b) by 0 days.

(21) Appl. No.: 15/922,350

(22) Filed: Mar. 15, 2018

(65) Prior Publication Data

US 2019/0284912 A1 Sep. 19, 2019

(51) Int. Cl.

| | |
|---|---|
| ***E21B 43/01*** | (2006.01) |
| ***E21B 17/01*** | (2006.01) |
| ***B63B 35/44*** | (2006.01) |
| ***B63B 21/50*** | (2006.01) |
| ***E21B 19/00*** | (2006.01) |
| ***B63B 22/02*** | (2006.01) |

(52) U.S. Cl.

CPC ..... *E21B 43/0107* (2013.01); *B63B 21/508* (2013.01); *B63B 22/02* (2013.01); *B63B 35/4413* (2013.01); *E21B 17/012* (2013.01); *E21B 17/015* (2013.01); *E21B 19/004* (2013.01)

(58) Field of Classification Search

CPC ..... B63B 2022/028; B63B 2035/442; B63B 22/023; B63B 21/508; B63B 35/4413; E21B 17/012; E21B 17/015; E21B 33/038; E21B 41/0021; E21B 43/0107

See application file for complete search history.

(56) References Cited

U.S. PATENT DOCUMENTS

| | | | | |
|---|---|---|---|---|
| 5,316,509 A * | 5/1994 | Boatman | B63B 21/508 114/230.12 |
| 5,558,467 A * | 9/1996 | Horton | B63B 35/4413 166/345 |
| 5,615,977 A * | 4/1997 | Moses | E21B 17/015 166/350 |
| 5,823,131 A | 10/1998 | Boatman et al. | |
| 6,113,314 A | 9/2000 | Campbell | |
| 6,263,824 B1 | 7/2001 | Balint et al. | |

(Continued)

FOREIGN PATENT DOCUMENTS

WO WO2019025936 A1 2/2019

OTHER PUBLICATIONS

Hustedt, B., International Search Report for International Patent Application No. PCT/IB2019/000238, dated Jul. 16, 2019, European Patent Office.

(Continued)

*Primary Examiner* — James G Sayre

(74) *Attorney, Agent, or Firm* — Jackson Walker, LLP

(57) ABSTRACT

The present invention provides a buoyant system and method for a hydrocarbon offshore floating platform to be coupled and decoupled from a subsea buoyant extension with risers slidably coupled thereto. The buoyant system can allow rigid risers to be coupled and decoupled and alternatively move between a first elevation below the offshore floating platform, such as at the buoyant extension, and a higher second elevation at the offshore floating platform independent of a spool piece, arch support, and flexible joint for the risers. The buoyant system can reduce riser stress by reducing bending required for the riser to form a catenary or other curved shape even as a rigid riser.

16 Claims, 12 Drawing Sheets

(56) References Cited

U.S. PATENT DOCUMENTS

| | | | | |
|---|---|---|---|---|
| 6,315,625 | B1 * | 11/2001 | Braud | B63B 21/50 114/230.12 |
| 7,197,999 | B2 | 4/2007 | Murray | |
| 7,669,660 | B1 | 3/2010 | Murray et al. | |
| 7,766,710 | B2 * | 8/2010 | Braud | B63B 22/023 441/4 |
| 8,342,777 | B2 * | 1/2013 | Baylot | B63B 21/508 114/230.13 |
| 8,881,826 | B2 * | 11/2014 | Crome | E21B 43/0107 166/338 |
| 2004/0240947 | A1 * | 12/2004 | Wetch | B63B 35/4413 405/224.2 |
| 2008/0029013 | A1 * | 2/2008 | Finn | B63B 21/50 114/264 |
| 2009/0158987 | A1 | 6/2009 | Ramachandran et al. | |
| 2015/0101522 | A1 * | 4/2015 | Younan | B63B 22/023 114/264 |
| 2015/0315853 | A1 | 11/2015 | Pollack | |
| 2017/0369133 | A1 | 12/2017 | Lambrakos et al. | |

OTHER PUBLICATIONS

Hustedt, B., Written Opinion for International Patent Application No. PCT/IB2019/000238, dated Jul. 16, 2019, European Patent Office.

* cited by examiner

BUOYANT SYSTEM AND METHOD WITH BUOYANT EXTENSION AND GUIDE TUBE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The disclosure generally relates to the production of hydrocarbons from subsea formations. More particularly, the disclosure relates to floating platform and disconnectable assemblies of risers and related support structures used in such production.

Description of the Related Art

In producing hydrocarbons from subsea formations, a number of wells are typically drilled into the seabed in positions that are not directly below or substantially within the outline of an offshore floating platform, such as a floating offshore production platform. The produced hydrocarbons are subsequently exported via subsea pipelines or other means. Current engineering practice links the offset wells with the floating platform through risers that generally have a catenary curve between the platform and the seabed. Wave motion, water currents, and wind cause movement of the floating offshore structure and/or risers themselves with corresponding flex and longitudinal stress in the risers.

The current state of the art has accommodated the flex in the risers by incorporating flexible risers. However, the flexible risers are generally more expensive and less reliable long-term than rigid pipe segments that are welded together.

Several types of risers are designed to be coupled to the floating offshore structure through guide tubes extending from the lower keel of the offshore structure to the upper part of the offshore structure. A guide tube is generally an elongated conduit that forms a guide through which the riser is pulled or otherwise moved from the seafloor and coupled to the offshore structure. The guide tube is attached to the offshore structure generally at an angle from the vertical, so as to be in line with a natural catenary angle that the installed riser would assume on a calm day or in line to form a lazy wave shape. As the offshore structure shifts laterally and vertically, the guide tube helps reduce stresses on the riser.

Typically, a tapered stress joint is placed near a lower exit location of the guide tube adjacent to one of the attachment points and is sized to control the riser stress. The main function of a guide tube stress joint is to provide flexible support for the riser.

Another option to bending flexibility through a tapered stress joint is to use a flexible joint on the riser. However, such a joint is still expensive and can cost as much or more as the tapered stress joints.

A further complication arises in some hostile environments, such as in locations prone to ice bergs and other locations prone to hurricanes or typhoons. To avoid a potentially catastrophic damage to a floating platform, the floating platform sometimes has sufficient time to be moved out of the way of an approaching iceberg or hurricane/typhoons. However, because the floating platform is typically connected to multiple risers, the time to disconnect and the large expense renders such operations difficult and expensive.

Some efforts have previously been done to address a more quickly disconnectable assembly from a floating platform. A subsea module can support risers below the water surface, while the remainder of the floating platform can be disconnected and temporarily moved to another location. For example, U.S. Pat. No. 7,197,999, entitled "Spar Disconnect System" illustrates a spar-type floating platform with a disconnectable subsea mooring buoy module. The disconnectable subsea module can facilitate separating the risers into an upper portion that remains with the floating platform, and a lower portion that remains with the subsea module, while the floating platform is disconnected and moved to a temporary location. FIGS. 11 and 12 of this patent with original reference numbers are copied for illustrative purposes as FIGS. 1A and 1B of the present application. The Abstract describes the system as:

> A spar-type offshore platform includes a buoyant upper hull structure [12] supporting a deck and having lower end in which is received a buoyant lower mooring module [14]. The upper hull structure is connected to the mooring module by connection lines. The upper hull structure is removed from the mooring module by disconnecting the connection lines from the upper hull structure while leaving the connection lines attached to the mooring module and while the mooring module remains moored to the seabed. The mooring module is lowered relative to the upper hull structure, allowing the latter to be moved away. The upper hull structure may be re-positioned over the mooring module, and the mooring module may be hauled upward into engagement with the lower end of the upper hull structure, so that the connection lines can be recovered and re-attached to the upper hull structure.

Another example is illustrated in U.S. Pat. No. 8,881,826, entitled "Installation For The Extraction Of Fluid From An Expanse Of Water, And Associated Method". FIGS. 1 and 4 of this patent with original reference numbers are copied for illustration as FIG. 2A and FIG. 2B of the present application. Flexible hoses are connected to the upper structure, and are lowered to the lower structure when the upper structure is being moved to another location. The flexible hoses bend around an arch 80 with an upper convex surface to allow the flexible movement between the upper and lower structures. The Abstract describes the installation as:

> This installation comprises an upper structure (12), and a flexible hose (16) capable of moving through the expanse of water (11B) between an upper connected configuration and a lower disconnected configuration. The installation comprises a lower structure (14) having a base (60) extending at a distance from the bottom (11A) of the expanse of water (11B). The upper structure (12) is capable of moving relative to the lower structure (14) between an extraction position and an evacuation position. The base (60) defines a passage (68) for travel of the flexible hose (16) as it moves between the upper connected configuration and the lower disconnected configuration and a stop (74) for retaining a connection head (92) of the hose (14), disposed in the travel passage (68), to keep the connection head (92) at a distance from the bottom (11A) of the expanse of water (11B) in the lower disconnected configuration.

A further example is illustrated in U.S. Pat. No. 7,669,660, entitled "Riser Disconnect And Support Mechanism". A series of risers that flexibly bend around a laterally extended support arch of a main subsea body can be lowered and raised between the main body portion and the arch. A floating platform can be connected to the subsea main body and the risers raised from the main body to be connected to the topside of the floating platform for production, and disconnected and lowered from the floating platform so that the floating platform moved when needed. FIGS. 1, 2 and 3 of this patent with original reference numbers are copied for illustrative purposes as FIGS. 3A, 3B, and 3C of the present application. The Abstract describes the system as:

A riser disconnect and support mechanism for flexible risers and umbilicals on an offshore structure with low under keel clearance. A main body portion [12] includes an inverted and truncated conical or convex section [14] substantially at the center of the main body portion. The main body portion and conical section receive risers [26] therethrough by means of a plurality of conduits [22] through the main body portion and conical section. A plurality of projections [16] extend radially outward from the main body portion. A plurality of arch-shaped riser supports [18] are provided on each projection to support risers and/or umbilical lines and control their bending radii. The projections extend out from the main body portion at a distance that allows the portions of the risers below the main body portion to hang at an angle and bend radius in accordance with the design tolerances of the risers to prevent buckling or damage due to excessive bending while keeping the risers from contacting the sea floor.

While the above examples address the persistent challenge of providing a structure that can be disconnected from the floating platform for reconnection later, each has challenges. The expense of arch supports, complexity of multiple connections between the endpoints of the subsea well to the working deck of the floating platform, and stress on the risers in the repetitive bending from lowering during disconnection times are some of the challenges. A less expensive and easier solution is needed.

SUMMARY OF THE INVENTION

The present invention provides a buoyant system and method for a hydrocarbon offshore floating platform to be coupled and decoupled from a subsea buoyant extension with risers slidably coupled thereto. The buoyant system can allow rigid or flexible risers to be coupled and decoupled and alternatively move between a first elevation below the offshore floating platform, such as at the buoyant extension, and a higher second elevation at the offshore floating platform independent of a spool piece, arch support, and flexible joint for the risers. The buoyant system can reduce riser stress by reducing bending required for the riser to form a catenary or other curved shape even as a rigid riser.

The disclosure provides a buoyant system configured to be detachable from an offshore floating platform, comprising: a buoyant extension having a buoyancy and configured to be detachably coupled with the offshore floating platform; and a first guide tube coupled to the buoyant extension and configured to allow a rigid portion of a riser to pass through the guide tube alternatively between a first elevation below the offshore floating platform and a higher second elevation at the offshore floating platform.

The disclosure further provides a method of using an offshore floating platform with a buoyant system having a buoyant extension and a first guide tube coupled to the buoyant extension and configured to allow a rigid portion of a riser to be moved through the guide tube alternatively between a first elevation below the offshore floating platform and a higher second elevation at the offshore floating platform, and wherein the riser has been coupled through the guide tube on the buoyant extension to the floating platform, the method comprising: disconnecting the riser from the floating platform; allowing the rigid portion of the riser to descend to the first elevation below the offshore floating platform while sliding through the first guide tube on the buoyant extension; disconnecting the floating platform from the buoyant extension with the riser remaining on the buoyant extension; and moving the floating platform to a location other than a location of the buoyant extension.

DETAILED DESCRIPTION

Figure 1A:
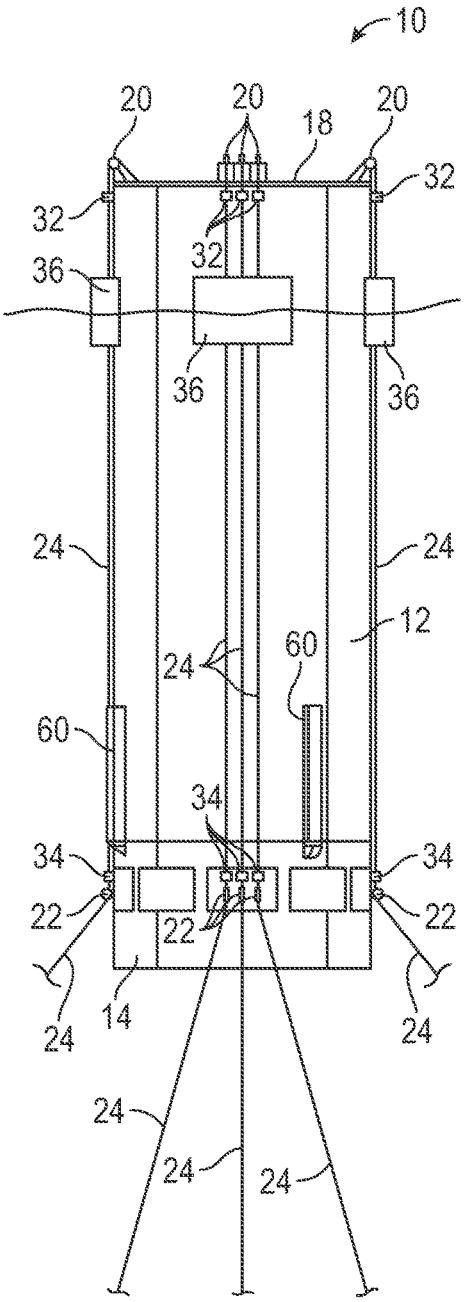
FIG. 1A (Prior Art)
FIG. 1A is a schematic cross sectional view of a known disconnect system with a buoyant upper hull structure connected with a buoyant lower mooring module.
Figure 1B:
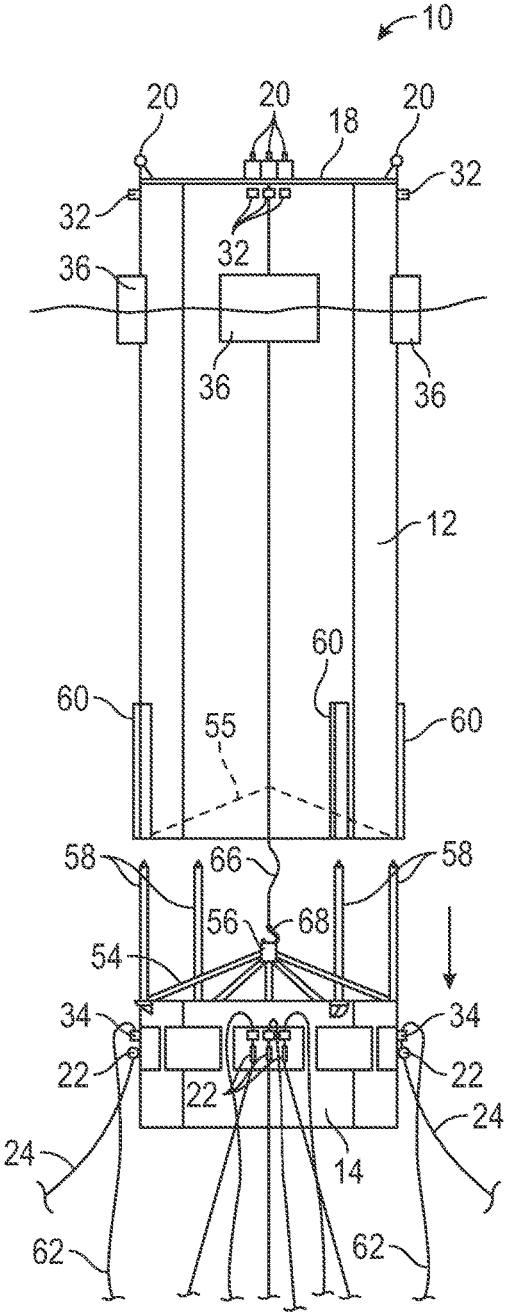
FIG. 1B (Prior Art)
FIG. 1B is a schematic cross sectional view of the known disconnect system of FIG. 1A with the buoyant upper hull structure disconnected with the buoyant lower mooring module.
Figure 2A:
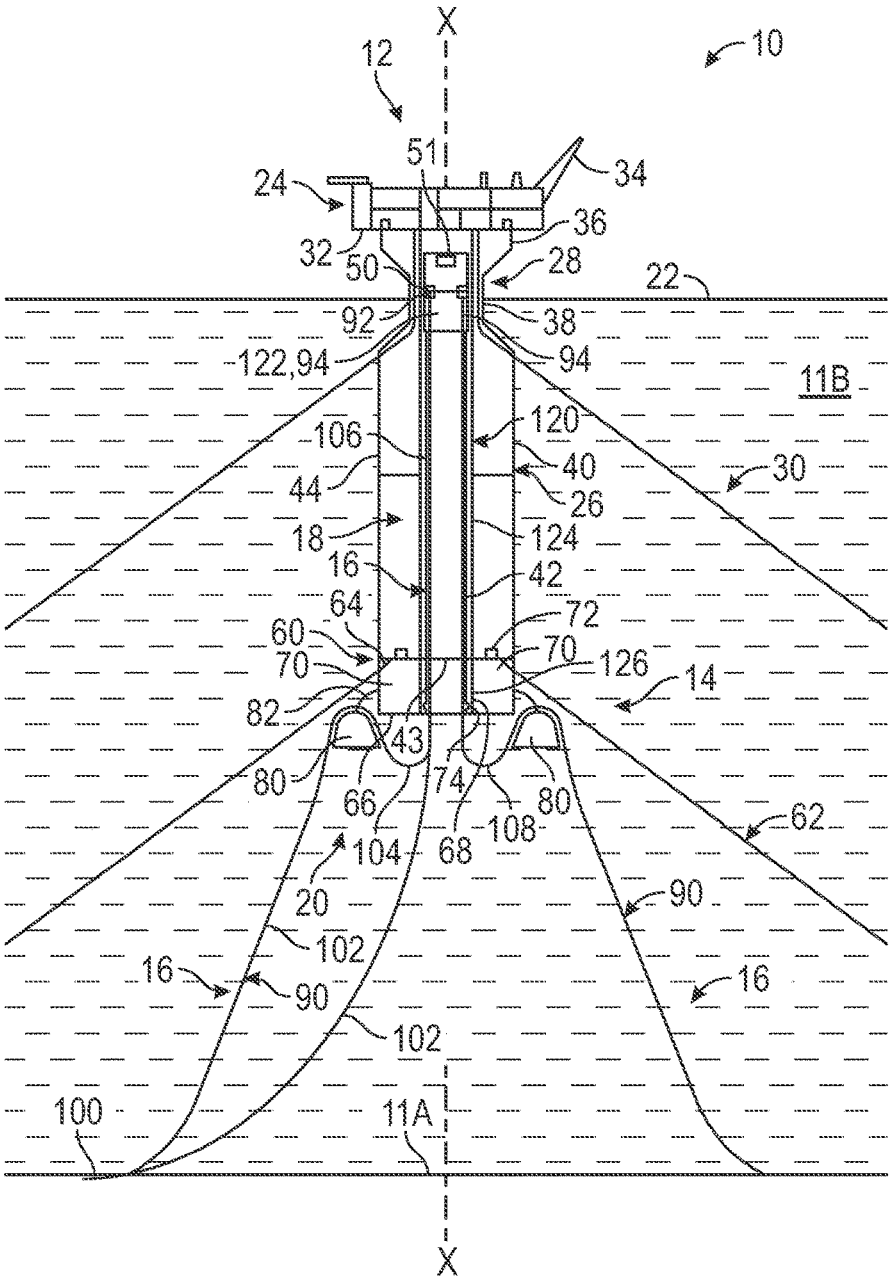
FIG. 2A (Prior Art)
FIG. 2A is a schematic cross sectional view of another known disconnect system with a buoyant upper hull structure connected with a buoyant lower mooring module.
Figure 2B:
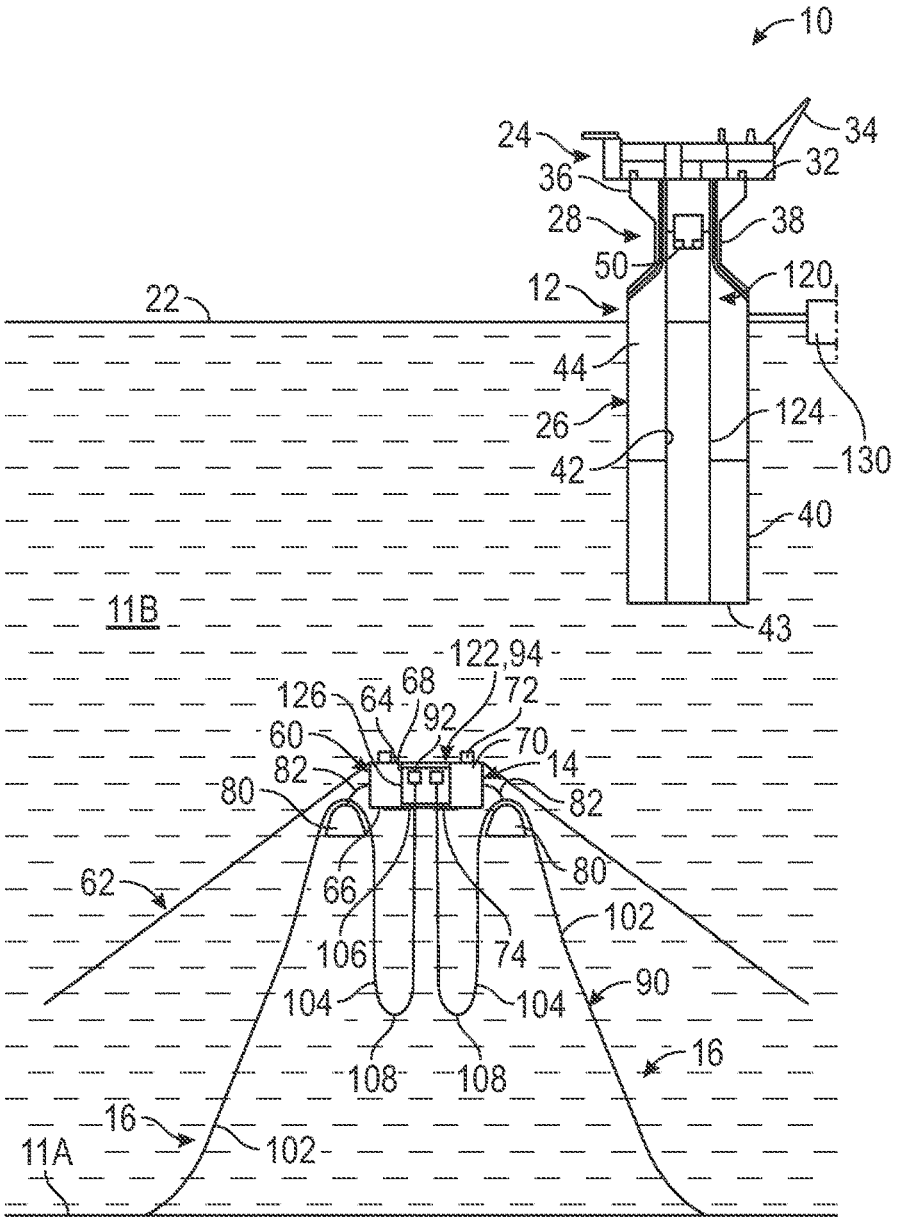
FIG. 2B (Prior Art)
FIG. 2B is a schematic cross sectional view of the known disconnect system of FIG. 2A with the buoyant upper hull structure disconnected with the buoyant lower mooring module.
Figure 3B:
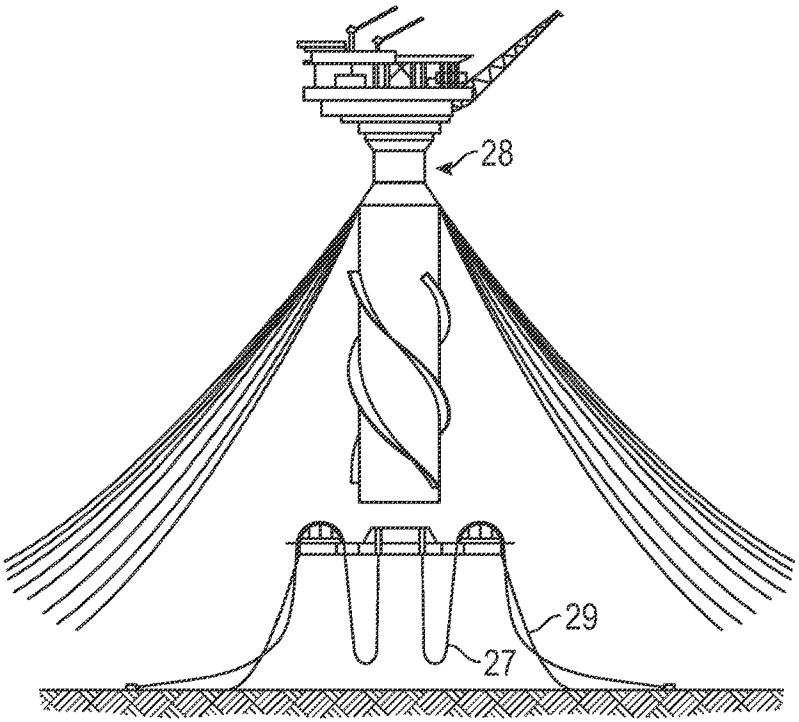
FIG. 3B (Prior Art)
FIG. 3B is a schematic side view of the known disconnect system of FIG. 3A with the buoyant upper hull structure disconnected with the buoyant lower mooring module.
Figure 3A:
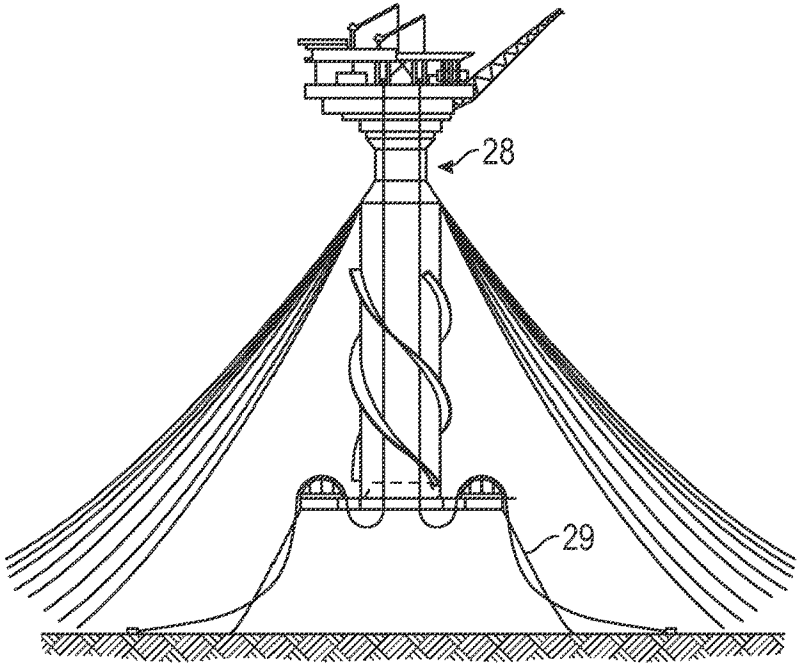
FIG. 3A (Prior Art)
FIG. 3A is a schematic side view of another known disconnect system with a buoyant upper hull structure connected with a buoyant lower mooring module.
Figure 3C:
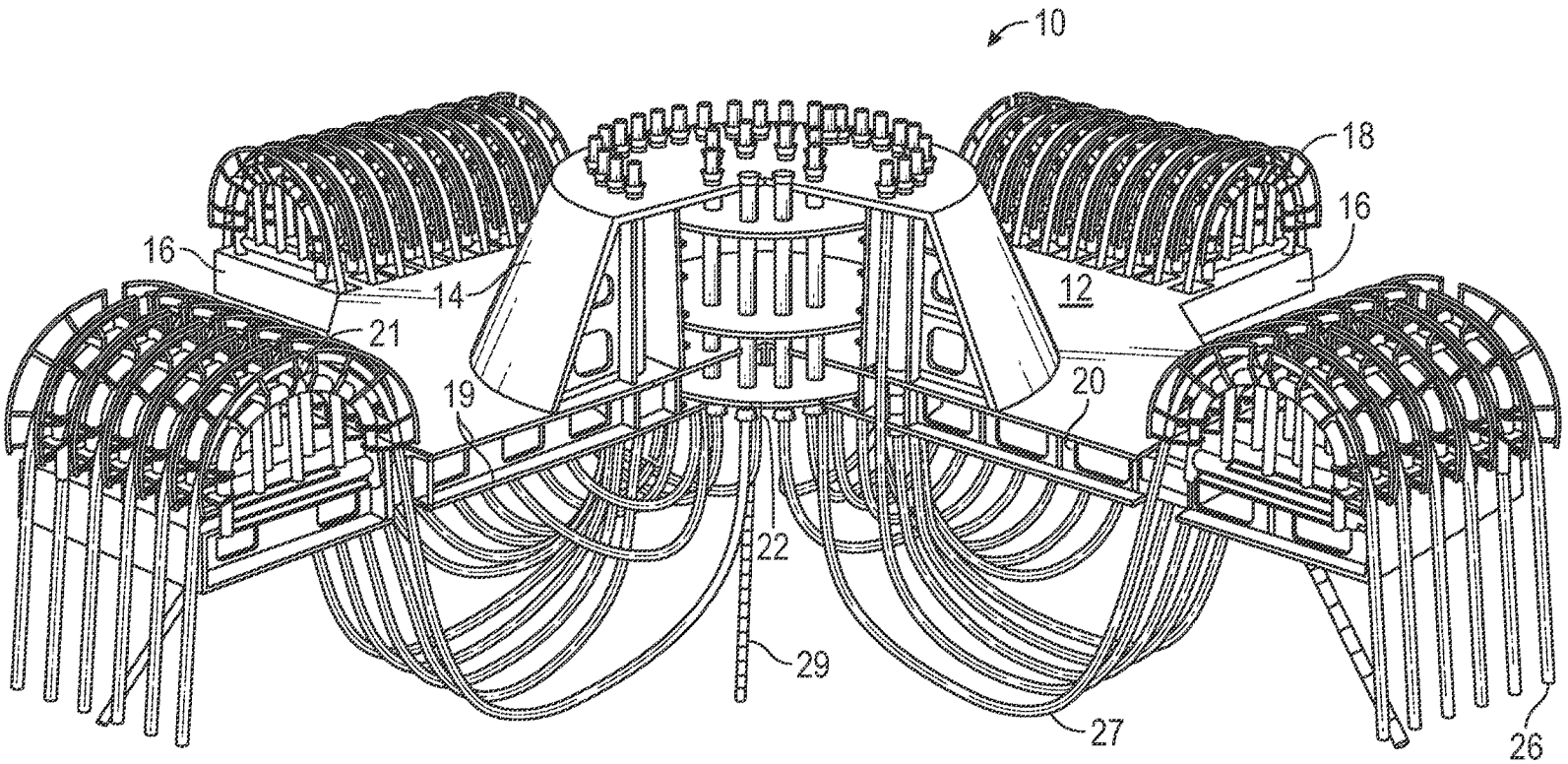
FIG. 3C (Prior Art)
FIG. 3C is a schematic perspective view of the buoyant lower mooring module of FIGS. 3A and 3B.

The Figures described above and the written description of specific structures and functions below are not presented to limit the scope of what Applicant has invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation or location, or with time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Further, the various methods and embodiments of the system can be included in combination with each other to produce variations of the disclosed methods and embodiments. Discussion of singular elements can include plural elements and vice-versa. References to at least one item may include one or more items. Also, various aspects of the embodiments could be used in conjunction with each other to accomplish the understood goals of the disclosure. Unless the context requires otherwise, the term "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The terms "top", "up", "upward", "bottom", "down", "downwardly", and like directional terms are used to indicate the direction relative to the figures and their illustrated orientation and are not absolute in commercial use but can vary as the assembly varies its orientation. The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions. Some elements are nominated by a device name for simplicity and would be understood to include a system of related components that are known to those with ordinary skill in the art and may not be specifically described. Various examples are provided in the description and figures that perform various functions and are non-limiting in shape, size, description, but serve as illustrative structures that can be varied as would be known to one with ordinary skill in the art given the teachings contained herein. As such, the use of the term "exemplary" is the adjective form of the noun "example" and likewise refers to an illustrative structure, and not necessarily a preferred embodiment.

The present invention provides a buoyant system and method for a hydrocarbon offshore floating platform to be coupled and decoupled from a subsea buoyant extension with risers slidably coupled thereto. The buoyant system can allow rigid risers to be coupled and decoupled and alternatively move between a first elevation below the offshore floating platform, such as at the buoyant extension, and a higher second elevation at the offshore floating platform independent of a spool piece, arch support, and flexible joint for the risers. The buoyant system can reduce riser stress by reducing bending required for the riser to form a catenary or other curved shape even as a rigid riser.

Figure 4:
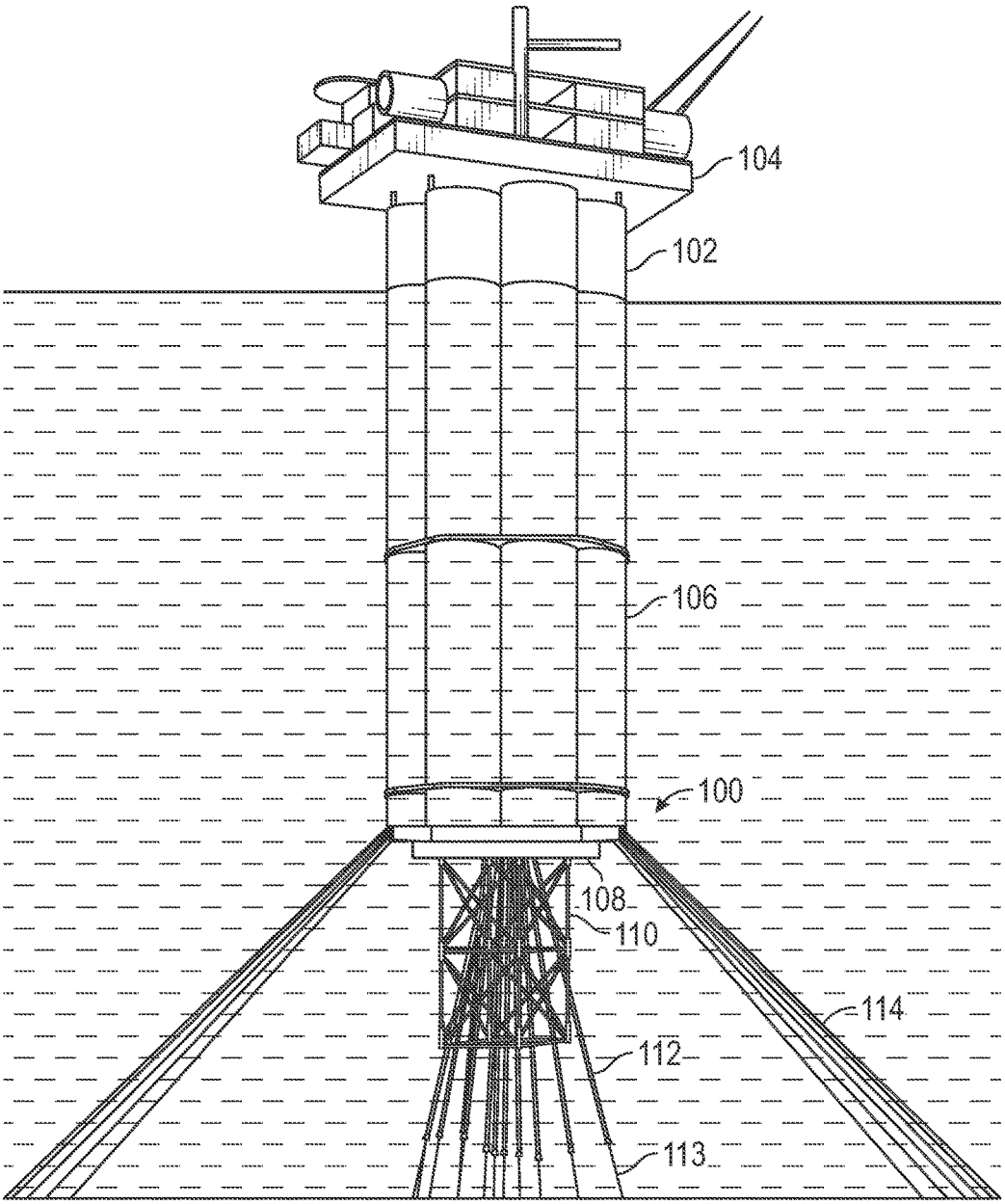
FIG. 4 is a schematic perspective view of an example of a buoyant system of the present invention having a buoyant extension that is coupled with a hydrocarbon offshore floating platform.

FIG. 4 is a schematic perspective view of an example of a buoyant system of the present invention having a buoyant extension that is coupled with a hydrocarbon offshore floating platform. The exemplary buoyant system 100 can include an offshore floating platform generally related to the hydrocarbon industry. The floating platform 102 can be, for example and without limitation, a spar, semisubmersible, floating production storage and offloading unit (FPSO) including a ship-shaped FPSO or spar-shaped FPSO and can be with or without a turret, floating storage and re-gas unit (FSRU), or other hydrocarbon-related floating platforms. In some embodiments, a turret can be coupled with the buoyant system, and a FPSO removably coupled with the turret and the buoyant system. The extension upper portion can be buoyant and at least partially subsea below the water surface, and can be wholly subsea when coupled with the offshore floating platform. The floating platform 102 generally includes a working surface, such as a topsides 104. The topsides can include, for example, well trees, valves, or other hydrocarbon-related equipment. The floating platform 102 generally also has an enclosed buoyant hull 106, which for purposes herein may include pontoons in some types of floating platforms.

The floating platform 102 can be detachably coupled with a buoyant extension 110. In general, an extension upper portion 108 of the buoyant extension 110 can form a transition for the buoyant extension 110 with the floating platform 102, and some such embodiments are illustrated herein. However, it is expressly stated that the buoyant extension 110 does not require the extension upper portion 108 for the buoyant extension 110 to be coupled to the floating platform 102. The buoyant extension 110 generally is at least partially buoyant. The buoyancy is generally sufficient for the weight of the structure with the risers and mooring lines coupled to the structure to maintain the risers above a seabed and reduce riser stress by reducing bending required for the riser to form a catenary or other curved shape even as a rigid riser. In some embodiments, the extension upper portion 108 can have sufficient buoyancy for the remaining portion of the buoyant extension 110. In other embodiments, the extension upper portion 108 as well as other structure of the buoyant extension 110 can both contribute to the buoyancy. For example and without limitation, tubular components of the buoyant extension 110 may be at least partially sealed to create buoyancy. Other chambers, buoyant fill material, or structure can be provided for the buoyant extension 110 to have buoyancy independent of the extension upper portion 108. In other embodiments, the extension upper portion 108 may not contribute a significant amount, if any, to the buoyancy of the buoyant extension 110 and the buoyancy can be designed into other portions of the structure of the buoyant extension 110. In yet other embodiments, the extension upper portion 108 may not be present, so that the buoyant extension 110 is designed for buoyancy without the extension upper portion 108.

The length of the remaining portion of the buoyant extension 110 can be for example and without limitation at least the length of the extension upper portion 108 and longer such as at least twice the length of the extension upper portion. In at least one embodiment, the buoyant extension can be an "open structure". An "open structure" is intended to mean a structure that allows water to pass through laterally, that is, the structure is not a sealed container with closed sides and closed bottom. An open structure buoyant extension 110 can be formed as a truss structure with vertical legs, horizontal legs, and cross bracing. Alternatively, the buoyant extension can be an at least partially closed container that restricts water passing through laterally, such as having sides and/or a bottom that allow at least some water to pass therethrough where the sides could be closed. The shape of the buoyant extension can vary and can include various geometrical shapes, including cylindrical, cubic, conical and frustoconical (such as without limitation having a larger base cross section than an upper cross section), and cross sections of square, rectangular, circular, elliptical, rhombus, and other polygons.

The buoyant extension 110 can be moored to a subsurface structure, such as a seabed, by one or more mooring lines 114 that for purposes herein can include traditional mooring lines or tendons. In some embodiments, the extension upper portion can be temporarily dynamically positioned, such as with thrusters, prior to being moored at a given location, particularly if the extension upper portion is wholly subsea, and reduce the need for mooring lines. In the embodiment shown in FIG. 4, the mooring lines 114 attached to the buoyant extension 110, such to the extension upper portion 108 if present, are sufficiently strong to also support the mooring of the floating platform 102 when coupled to the buoyant extension 110. Thus, no additional mooring lines would generally be needed separately to the floating platform. In other embodiments, the mooring lines can be coupled to the both the buoyant extension and the floating platform. In yet other embodiments, the mooring lines can be coupled to just the floating platform, and the buoyant extension can remain in the general location by risers (described below) coupled thereto.

At least one riser 113 and generally a plurality of risers are slidably coupled through the buoyant extension 110 and the extension upper portion 108 if present between a first elevation below the offshore floating platform, such as at the buoyant extension 110, and a generally higher second elevation at the offshore floating platform 102, as explained below. The term "riser" is broadly used herein and includes Steel Catenary Risers (SCRs), Steel Lazy Wave Risers (SLWRs), rigid risers, flexible risers, and umbilical lines. Advantageously, the riser can be rigid or at least partially rigid for reduced cost.

Figure 7B:
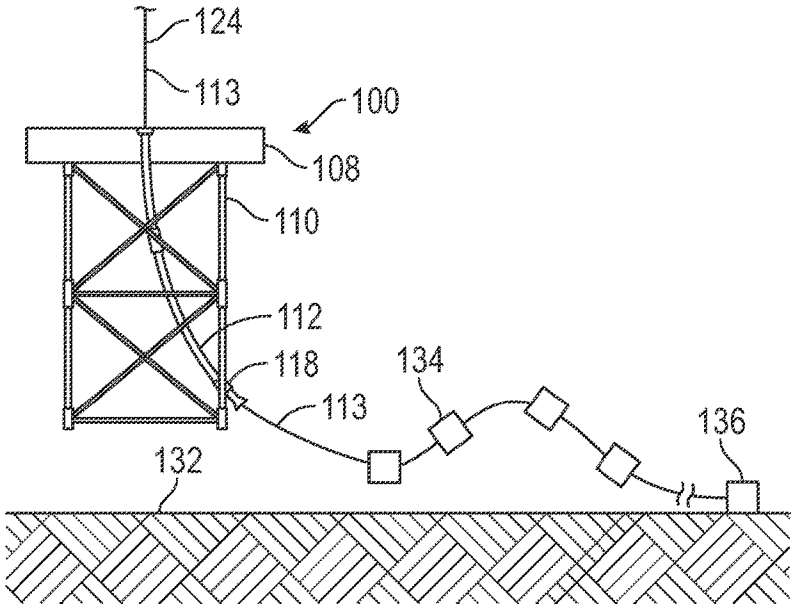
FIG. 7B is a schematic perspective detail view of the floating platform decoupled from the buoyant system of FIG. 4.
Figure 7A:
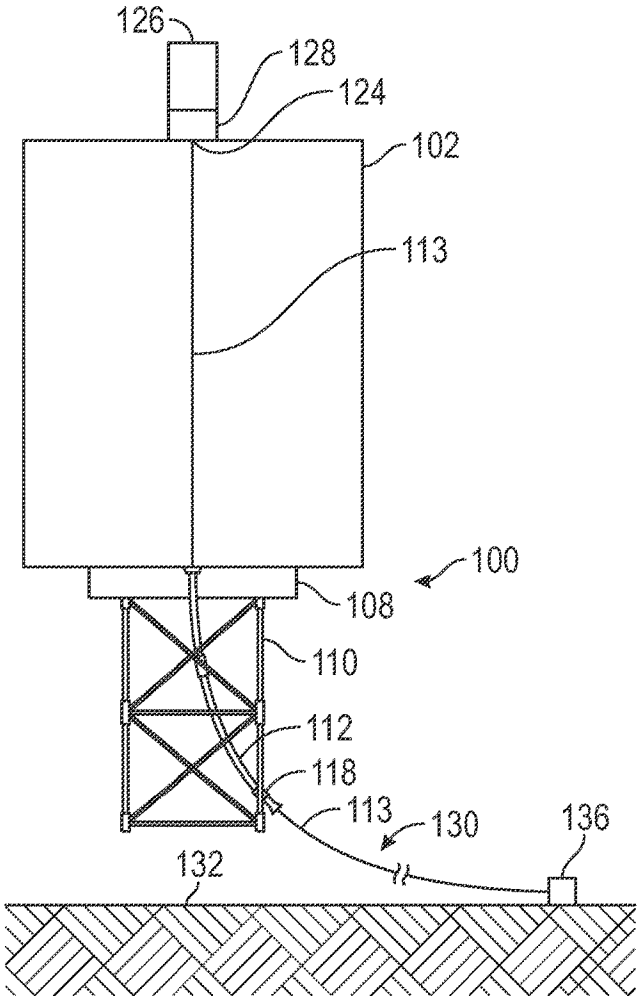
FIG. 7A is a schematic side view of the offshore floating platform coupled with the buoyant system.

The extension upper portion 108 and buoyant extension 110 are configured to support and guide the riser 113 independent of a spool piece, arch support, and flexible joint that prior efforts relied on. While such structures may be optionally present, the system is configured to depend on the buoyant extension without needing such structures. While flexible risers can be used, the system can also use rigid risers. In at least one embodiment, the risers can be continuous between subsea production equipment and production equipment on the floating platform, where at least an upper portion of the riser could pass through the buoyant extension and the extension upper portion, if present (as illustrated in FIGS. 7A and 7B described below). The upper portion of the riser can be coupled to the floating platform and decoupled and lowered to the buoyant extension, so the floating platform can be decoupled from the buoyant extension. The buoyant system provides latitude to use at least partially, if not fully, rigid risers due to the ability of the system to allow rigid risers to slide through the supporting structure of the buoyant extension at an elevation above the seabed maintained by buoyancy to reduce stresses on the curvature of the riser. The invention can provide less expense, less complication, and more reliability for connecting risers between subsea production equipment and the floating platform.

Figure 5:
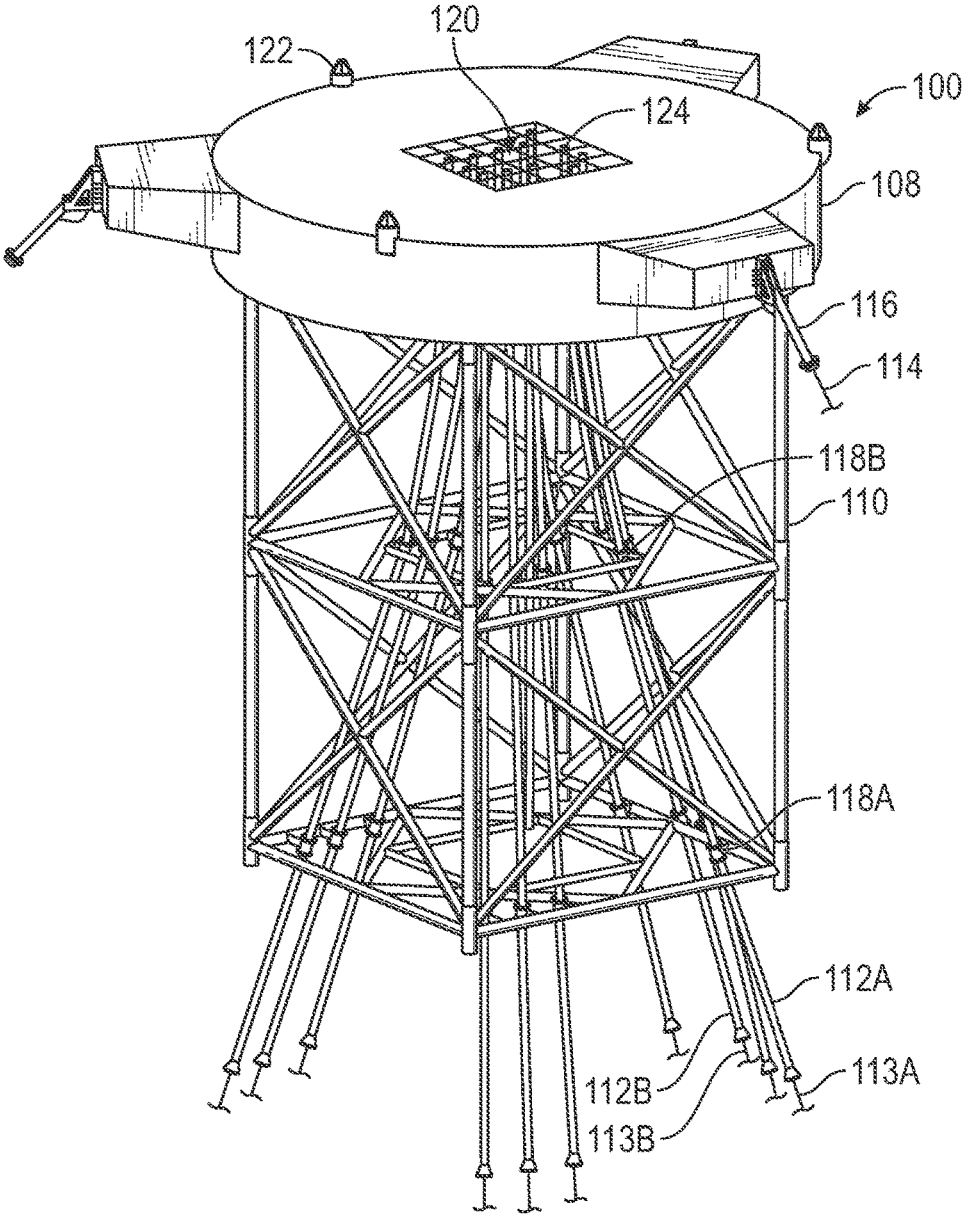
FIG. 5 is a schematic perspective view of the buoyant system of FIG. 4.
Figure 6B:
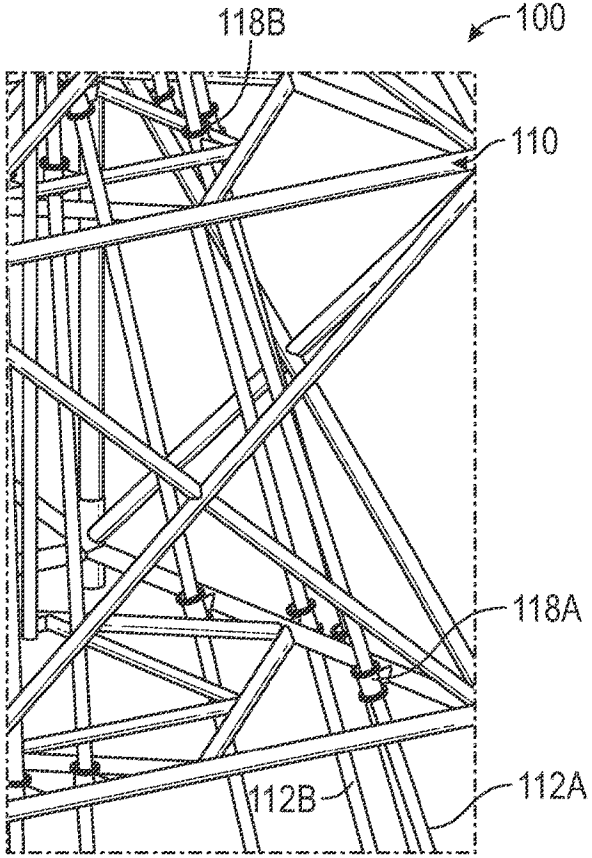
FIG. 6B is a schematic perspective detail view of the buoyant system of FIG. 6A.
Figure 6A:
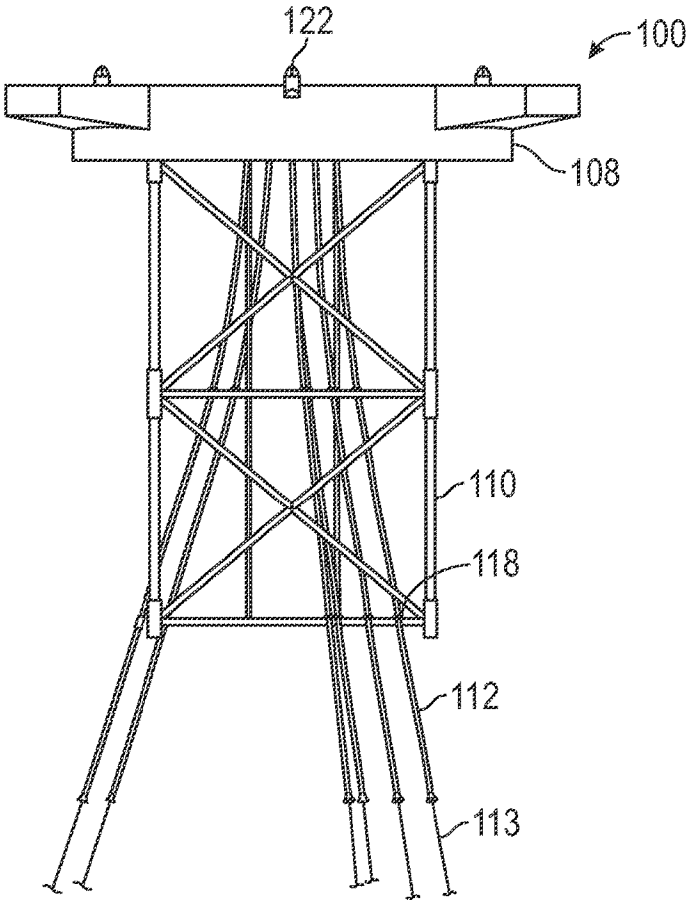
FIG. 6A is a schematic side view of the buoyant system of FIG. 4.

FIG. 5 is a schematic perspective view of the buoyant system of FIG. 4. FIG. 6A is a schematic side view of the buoyant system of FIG. 4. FIG. 6B is a schematic perspective detail view of the buoyant system of FIG. 6A. The extension upper portion 108 can be coupled to the buoyant extension 110, as described above, with docking pins 122 guiding the coupling. The extension upper portion 108 can include a riser guide structure 120, such as a centerwell, moonpool plate, or structural framing. The riser guide structure 120 (also shown in FIGS. 9 and 10) generally includes a plurality of openings sized to allow one or more risers 113A and 113B (generally, 113) to pass therethrough and be separated from each other by a predefined distance formed through the grid structure. A riser guide tube 112 for a given riser 113 can be coupled to the buoyant extension 110 with at least one support 118, such as supports 118A and 118B. The guide tubes 112 are sized to allow the risers 113 to slide therethrough and provide support for the riser as it curves. For example, a first riser guide tube 112A can be coupled to the buoyant extension 110 in a first location at a nonvertical angle. A second riser guide tube 112B can be coupled to the buoyant extension 110 at a second location, perhaps at a different angle than the first guide tube 112A. Further, the guide tube 112 can be coupled to the riser guide structure 120 (shown in FIGS. 8 and 9), so that the riser 113 is slidably supported also through the extension upper portion. Generally, the riser guide tube 113 will extend below the buoyant extension 110 at an angle to help transition the riser into a catenary shape, a lazy wave curve, or other curved shape. For example, the angle can correspond to a typical angle that the riser shape will naturally assume, that is, a catenary shape that is defined mathematically by formulae, as a suspended riser naturally approaches subsea production equipment at the lower end of the riser. The alignment of the one or more guide tubes 112 can assist in aligning the riser 113 with the curved shape. In some instances, a guide tube can align a riser in at least a partial vertical angle. Other risers 113 can have other guide tubes 112 coupled to the buoyant extension 110 in like manner. For example, a guide tube 112B is illustrated attached to external surfaces of frame members of the buoyant extension 110 and can slidably guide the riser 113B therethrough. The extension upper portion 108 can further include a mooring coupler 116 such as a fairlead, padeye, or other structure for coupling with securing lines, including mooring lines and tendons. The mooring coupler 116 extends outwardly from the extension upper portion and, for example, can be coupled with the extension mooring line 114.

FIG. 7A is a schematic side view of the offshore floating platform coupled with the buoyant system The offshore floating platform 102 can be coupled with an extension upper portion 108 of the buoyant extension 110. A lower end of the riser 113 can be coupled with subsea production equipment 136, such as a well head at the seabed, a pipe line end terminator (PLET), a manifold, or other equipment used for flowing hydrocarbons. The riser 113 can extend through the guide tube 112 coupled with the buoyant extension 110 and the extension upper portion 108 to the offshore floating platform 102. At the offshore floating platform, the riser can be fluidicly coupled (directly or indirectly) on an upper end 124 of the riser to equipment to allow fluid to flow between the riser and the equipment, such as to a valve 128 that could be on a well tree 126 or other equipment on the platform.

FIG. 7B is a schematic perspective detail view of the floating platform decoupled from the buoyant system of FIG. 4. The upper end 124 of the riser 113 can be decoupled from the valve 128 (or other equipment) and lowered from the floating platform 102 to the buoyant extension 110, such as to the extension upper portion 108, if present, below the floating platform, while lower portions of the riser can be slidably lowered through the guide tube 112 to a location below the buoyant extension 110 toward the seabed 132. The floating platform 102 can be moved to another location, leaving the buoyant extension 110 to support the riser 113.

When appropriate, the floating platform 102 can be brought back to the extension upper portion 108 and coupled thereto. Equipment, such as winches and the like, can raise the upper end 124 of the riser 113 and fluidicly couple the upper end to production equipment on the floating platform, such as a well tree 126 and/or valve 128.

In some embodiments, it may be advantageous to attach one or more buoyancy modules 134 to the riser 113. For example, the depth of the buoyant extension may be too shallow to allow the riser 113 to maintain a normal catenary shape or other appropriate curve that may overstress the riser when the riser is lowered from the floating platform to the buoyant extension. In other scenarios, the floating platform could have a large offset response that could overstress the riser. One or more such buoyancy modules 134 may be advantageously used to elevate the riser 113 above the seabed 132 to help avoid sharp bends and overstressing the riser as it curves to the subsea production equipment.

Figure 8:
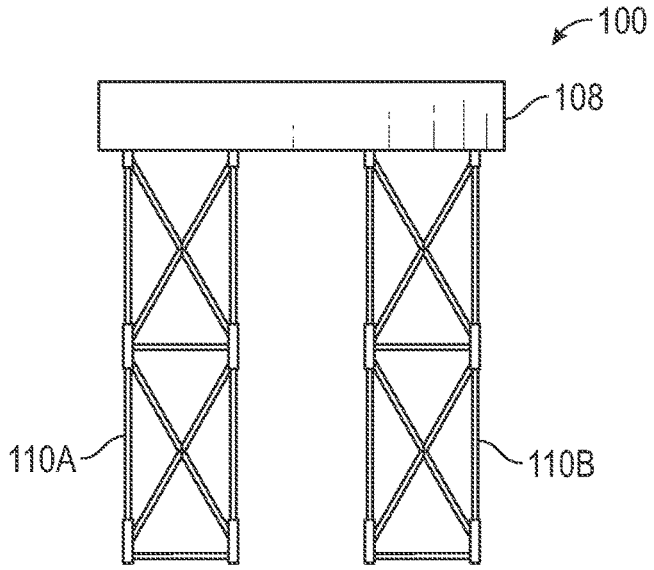
FIG. 8 is a schematic side view of another example of the buoyant system.

FIG. 8 is a schematic side view of another example of the buoyant system. A plurality of two or more buoyant extensions, such as the buoyant extensions 110A and 110B, can optionally be used with an extension upper portion 108 to transition to coupling with an offshore floating platform. Risers can be guided in one or more of the buoyant extensions and associated guide tubes, as described above.

Figure 9:
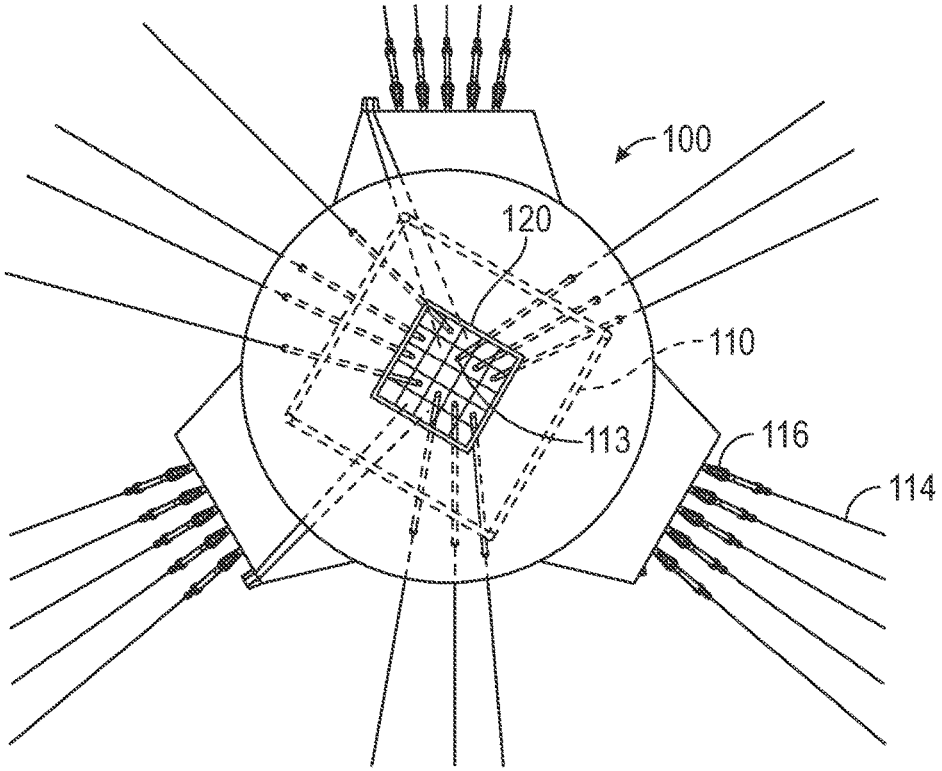
FIG. 9 is a schematic top view of an embodiment of the buoyant system.

FIG. 9 is a schematic top view of an embodiment of the buoyant system. The buoyant extension 110, such as at the extension upper portion 108, can have a plurality of mooring lines 114 extending from the mooring couplers 116 around the extension periphery. The mooring lines can be sufficiently strong to also support mooring of the floating platform by the platform being coupled to the buoyant extension 110. This embodiment can avoid separately mooring the floating platform in addition to mooring the buoyant extension. The exemplary riser guide structure 120 can provide a grid for spacing the risers 113.

Figure 10:
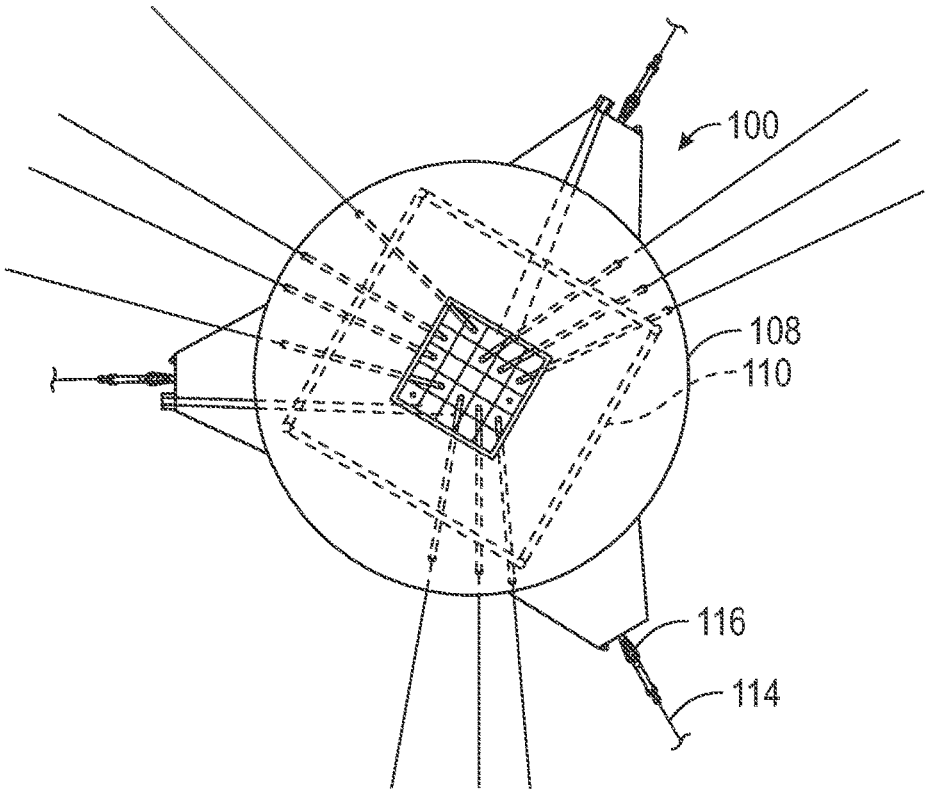
FIG. 10 is a schematic top view of another embodiment of the buoyant system.

FIG. 10 is a schematic top view of another embodiment of the buoyant system. In this embodiment, the buoyant extension 110 can be moored with sufficient mooring lines 114, such as from mooring couplers 116, to primarily support itself when disconnected from the floating platform. Therefore, the floating platform 102, described above, could be separately moored when coupled with the buoyant extension.

Figure 11:
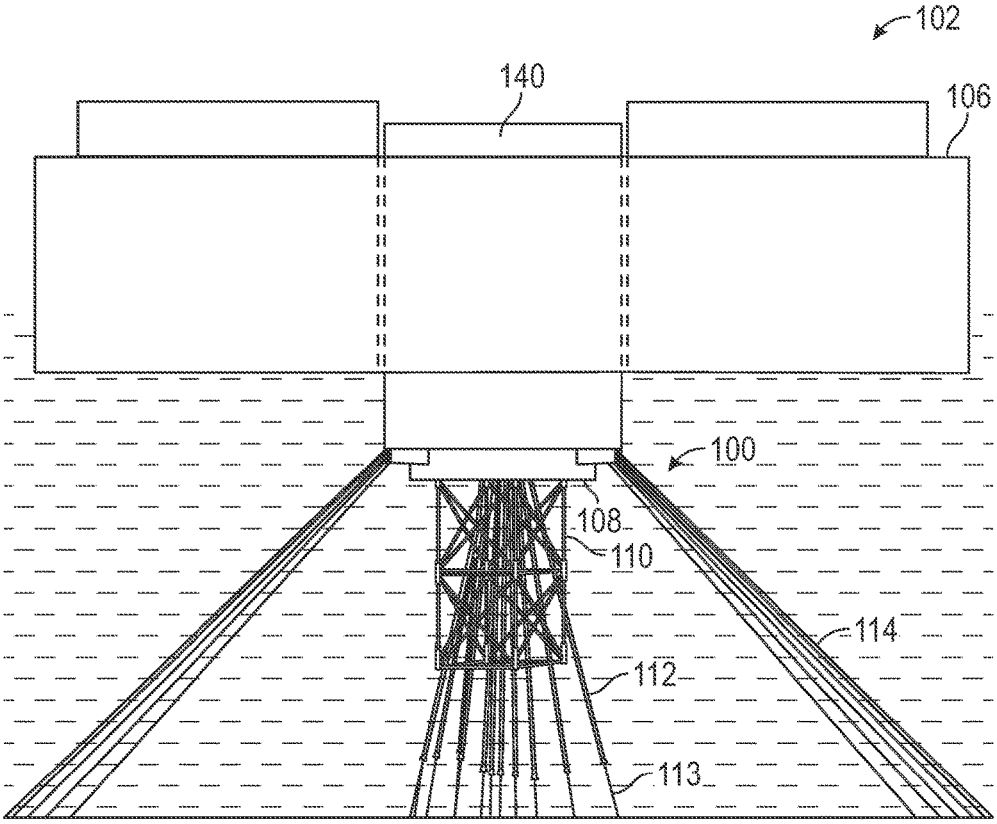
FIG. 11 is a schematic perspective view of a hydrocarbon offshore floating platform coupled with another embodiment of the buoyant system.

FIG. 11 is a schematic perspective view of a hydrocarbon offshore floating platform coupled with another embodiment of the buoyant system. The offshore floating platform 102 could be a vessel with a turret 140, such as an FPSO. The turret 140 can be coupled with the buoyant extension 110 in one or more variations. In some embodiments, the vessel with the turret can be removably coupled to the buoyant extension 110 with optionally an extension upper portion 108. The vessel with the turret can be decoupled from the buoyant extension and moved to another location, as has been described above. In other embodiments, the vessel with the turret 140 can be coupled with the buoyant extension 110. The vessel can be decoupled from the turret (and buoyant extension), the turret generally can be sufficiently lowered with the buoyant extension to provide clearance for the vessel to move, and the vessel can be moved to another location without the turret.

The system can include the mooring lines 114 coupled to the buoyant extension (or buoyant extension and turret), as described above. Risers 113 can be slidably coupled in guide tubes 112 and extend from the platform through the buoyant extension to subsea equipment below the platform.

Other and further embodiments utilizing one or more aspects of the inventions described above can be devised without departing from the disclosed invention as defined in the claims. For example, various shapes of extension upper portions and buoyant extensions and other variations can occur in keeping within the scope of the claims, and other variations.

The invention has been described in the context of preferred and other embodiments, and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalents of the following claims.

What is claimed is:

1. A buoyant system configured to be detachable from an offshore floating platform, comprising:

a buoyant extension having a buoyancy and configured to be detachably coupled with the offshore floating platform; and a first guide tube coupled to the buoyant extension and configured to allow a rigid portion of a riser to pass through the guide tube alternatively between a first elevation below the offshore floating platform and a higher second elevation at the offshore floating platform and allow the rigid portion of the riser to descend to the first elevation below the offshore floating platform while sliding through the first guide tube on the buoyant extension.

2. The system of claim 1, wherein the buoyant extension comprises an extension upper portion.

3. The system of claim 2, wherein the extension upper portion is configured to provide a buoyancy to the buoyant extension.

4. The system of claim 1, wherein the buoyant extension comprises members having buoyancy.

5. The system of claim 1, wherein the buoyant extension comprises a truss configured to allow water to laterally flow through the buoyant extension.

6. The system of claim 1, wherein the buoyant extension is configured to guide the rigid portion of the riser at a nonvertical angle independently of a spool piece, arch support, and flexible joint for the riser.

7. The system of claim 1, wherein the system further comprises the riser, and wherein the riser is a rigid riser from a subsea production equipment to be coupled to the offshore floating platform.

8. The system of claim 1, further comprising a second guide tube coupled to the buoyant extension at a different angle than the first guide tube.

9. The system of claim 1, further comprising a buoyancy module configured to be coupled to the riser at an elevation below the buoyant extension.

10. The system of claim 1, further comprising a plurality of mooring lines coupled to the buoyant extension and configured to moor the floating platform when the floating platform is coupled with the buoyant extension.

11. The system of claim 1, wherein the system further comprises the riser, and wherein the riser comprises at least a flexible portion below the buoyant extension.

12. The system of claim 1, wherein the buoyant extension comprises a riser guide structure configured to guide a plurality of risers.

13. A floating platform coupled with the buoyant system of claim 1, wherein the floating platform comprises a topsides with a valve, and wherein the riser from the buoyant extension is configured to be fluidicly coupled with the valve.

14. A floating platform coupled with the buoyant system of claim 1, wherein the floating platform comprises a topsides with a well tree, and wherein the riser from the buoyant extension is configured to be fluidicly coupled with the well tree.

15. A method of using an offshore floating platform with a buoyant system having a buoyant extension and a first guide tube coupled to the buoyant extension and configured to allow a rigid portion of a riser to be moved through the guide tube alternatively between a first elevation below the offshore floating platform and a higher second elevation at the floating platform, and wherein the riser has been coupled through the guide tube on the buoyant extension to the floating platform, the method comprising:

disconnecting the riser from the floating platform;

allowing the rigid portion of the riser to descend to the first elevation below the offshore floating platform while sliding through the first guide tube on the buoyant extension;

disconnecting the floating platform from the buoyant extension with the riser remaining on the buoyant extension; and moving the floating platform to a location other than a location of the buoyant extension.

16. The method of claim 15, wherein allowing the riser to slide through the first guide tube on the buoyant extension comprises allowing the rigid portion of the riser to descend below the buoyant extension at a nonvertical angle independent of a spool piece, arch support, and flexible joint for the riser.

* * * * *